US009133594B2

(12) United States Patent
Hurley

(10) Patent No.: US 9,133,594 B2
(45) Date of Patent: Sep. 15, 2015

(54) GROUND ANCHOR SYSTEM AND METHOD OF INSTALLATION

(71) Applicant: James Hurley, Edgewater, MD (US)

(72) Inventor: James Hurley, Edgewater, MD (US)

( * ) Notice: Subject to any disclaimer, the term of this patent is extended or adjusted under 35 U.S.C. 154(b) by 0 days.

(21) Appl. No.: 13/969,020

(22) Filed: Aug. 16, 2013

(65) Prior Publication Data

US 2014/0053476 A1 Feb. 27, 2014

Related U.S. Application Data

(60) Provisional application No. 61/692,312, filed on Aug. 23, 2012.

(51) Int. Cl.
*E02D 5/80* (2006.01)

(52) U.S. Cl.
CPC ..... *E02D 5/80* (2013.01); *Y10T 29/49826* (2015.01)

(58) Field of Classification Search
CPC ..... E02D 5/80; E02D 5/803; E04H 15/62; Y10T 29/49826
USPC ..... 52/155, 156, 157, 160, 161, 166, 146, 52/147, 148, 295
See application file for complete search history.

(56) References Cited

U.S. PATENT DOCUMENTS

| | | | | | |
|---|---|---|---|---|---|
| 1,521,265 | A | * | 12/1924 | Anderson | 29/275 |
| 1,550,276 | A | * | 8/1925 | Nilson | 52/158 |
| 1,721,436 | A | * | 7/1929 | Dubois et al. | 52/158 |
| 2,870,884 | A | * | 1/1959 | Mazur | 52/158 |
| 3,143,817 | A | * | 8/1964 | Paulson | 40/607.06 |
| 3,341,993 | A | * | 9/1967 | Lavond et al. | 52/158 |
| 3,500,598 | A | * | 3/1970 | Ettinger | 52/155 |
| 3,848,367 | A | * | 11/1974 | Barnes | 52/157 |
| 4,026,080 | A | | 5/1977 | Meikle | |
| 4,063,567 | A | * | 12/1977 | Martin et al. | 135/118 |
| 4,068,427 | A | * | 1/1978 | Camardo | 52/127.2 |
| 4,079,556 | A | * | 3/1978 | Luck et al. | 52/127.2 |
| 4,258,514 | A | * | 3/1981 | St. Clair | 52/86 |
| 4,400,114 | A | * | 8/1983 | Pickett et al. | 405/303 |
| 4,452,018 | A | * | 6/1984 | Hill | 52/155 |
| 4,679,369 | A | * | 7/1987 | Kinsley et al. | 52/155 |
| 4,825,600 | A | * | 5/1989 | Osgood, Sr. | 52/4 |
| 4,825,604 | A | | 5/1989 | Manning | |
| 5,171,108 | A | * | 12/1992 | Hugron | 405/259.1 |
| 5,243,795 | A | * | 9/1993 | Roberts | 52/158 |
| 5,515,656 | A | * | 5/1996 | Mihalich | 52/155 |
| 5,647,179 | A | * | 7/1997 | Hayashi et al. | 52/235 |
| 5,740,827 | A | * | 4/1998 | Swarringim | 135/118 |
| 6,659,702 | B2 | * | 12/2003 | Kitayama et al. | 411/546 |
| 7,047,696 | B2 | * | 5/2006 | DiDomenico | 52/166 |
| 7,555,870 | B1 | * | 7/2009 | Schiltz et al. | 52/155 |

(Continued)

*Primary Examiner* — James Ference
(74) *Attorney, Agent, or Firm* — Hayes Soloway PC

(57) ABSTRACT

An anchor apparatus, ground anchor system, and method of using a ground anchor system are provided. The anchor apparatus includes a base plate having a top surface and a substantially planar bottom surface, wherein the base plate has a plurality of picket-guide apertures formed therein between the top surface and the substantially planar bottom surface. At least one picket is removably positioned in at least a portion of the picket-guide apertures. An anchor portion is formed at a first end of the base plate, wherein the anchor portion has an anchor aperture formed through the first end of the base plate, the anchor portion further comprising a ground face surface proximate to the anchor aperture, wherein a distance between the top surface and the ground face surface is less than a distance between the top surface and the substantially planar bottom surface.

16 Claims, 10 Drawing Sheets

(56) References Cited

U.S. PATENT DOCUMENTS

| | | | | |
|---|---|---|---|---|
| 7,624,545 | B2 * | 12/2009 | Turley | 52/162 |
| 7,713,003 | B2 * | 5/2010 | Agg | 405/259.1 |
| 7,743,886 | B2 * | 6/2010 | Feemster et al. | 182/107 |
| 7,918,622 | B2 * | 4/2011 | Whitford | 404/6 |
| 2007/0181171 | A1 * | 8/2007 | Roberts | 135/118 |
| 2008/0276549 | A1 * | 11/2008 | Turley | 52/166 |
| 2010/0051384 | A1 * | 3/2010 | Currie | 182/107 |

* cited by examiner

GROUND ANCHOR SYSTEM AND METHOD OF INSTALLATION

CROSS REFERENCE TO RELATED APPLICATION

This application claims benefit of U.S. Provisional Application Ser. No. 61/692,312, entitled, "Ground Anchor System and Method of Installation" filed Aug. 23, 2012, the entire disclosure of which is incorporated herein by reference.

FIELD OF THE DISCLOSURE

The present disclosure is generally related to anchors and more particularly is related to ground anchor systems and methods of installation of ground anchor systems.

BACKGROUND OF THE DISCLOSURE

Natural objects, such as a tree or a heavy rock, can be used as a ground anchor to station movable objects. However, naturally occurring ground anchors are not always available when and/or where they are required. In addition, naturally occurring ground anchors are not always sufficient, particularly when a strong anchoring point is needed and a simple stake driven into the ground is insufficient. Some existing ground anchoring systems feature multiple pickets or stakes, particularly those that involve each stake being secured to the next stake by a stake tie or a rigid bar.

The conventional ground anchoring systems share common drawbacks in design. First, the parts of the ground anchoring systems are separable, with each stake being secured to the next stake by a stake tie. Second, the ground anchoring systems require multiple steps and separate treatment for the separate parts which must be placed, driven and tensioned separately to achieve the desired anchoring effect. Third, the process to engage the ground anchoring systems is very time consuming given that each stake is individually placed, driven and secured into the ground by a series of steps and adjustment of independent parts.

Other existing ground anchoring systems have a plate with holes, through which spikes are driven to join and secure the plate to the ground. An anchoring mount is provided on the plate for attaching a rope or cable. These ground anchoring systems share common drawbacks as well. First, the anchoring systems generally use tapered spikes, extending outwardly from top to bottom. These spikes provide only limited resistance to movement once driven into the ground. If pulled hard enough, these spikes have a tendency to move as they plow through the ground and, thereby weaken their anchorage to the ground. Second, the retention capability provided by these anchoring systems is directly proportional to the number of spikes used and correspondingly, the size of the plate. Thus, if a large retention capability is needed, the only option available is to use more spikes, which correspondingly would require a larger anchoring plate in order to accommodate the spikes.

Furthermore, existing anchoring systems are heavy and cumbersome, especially those intended to provide significant retention capability with the ground. A problem with such anchoring systems is that they require the user to grip a planar surface, that is the anchor plate, and, thus, the edges of the planar surface when carrying or holding the anchoring plate are pressed into the user's palm, leaving their fingers to pass through the picket receiving aperture to achieve a proper grip. While such a requirement may not seem too burdensome, the user may also be carrying other items in his hand and may be required to squeeze tightly to hold such items, causing the edges of the anchoring plate to press into his hand. In addition, some anchor plates are quite large and may require tight handling simply due to their length and weight.

Thus, a heretofore unaddressed need exists in the industry to address the aforementioned deficiencies and inadequacies.

SUMMARY OF THE DISCLOSURE

Embodiments of the present disclosure provide an anchor apparatus. Briefly described, in architecture, one embodiment of the apparatus, among others, can be implemented as follows. A base plate has a top surface and a substantially planar bottom surface, wherein the base plate has a plurality of picket-guide apertures formed therein between the top surface and the substantially planar bottom surface. At least one picket is removably positioned in at least a portion of the picket-guide apertures. An anchor portion is formed at a first end of the base plate, wherein the anchor portion has an anchor aperture formed through the first end of the base plate, the anchor portion further comprising a ground face surface proximate to the anchor aperture, wherein a distance between the top surface and the ground face surface is less than a distance between the top surface and the substantially planar bottom surface.

The present disclosure can also be viewed as providing a ground anchor system. Briefly described, in architecture, one embodiment of the system, among others, can be implemented as follows. A base plate has a top surface and a substantially planar bottom surface, wherein the base plate has a plurality of picket-guide apertures formed therein between the top surface and the substantially planar bottom surface, wherein the substantially planar bottom surface is positioned abutting a ground surface. A plurality of pickets has an elongated substantially cylindrical body and a tapered end. Each of the plurality of pickets is removably positioned in one of the plurality of picket-guide apertures along the elongated substantially cylindrical body of the plurality of pickets, wherein the tapered end of the plurality of pickets is positioned below the ground surface. An anchor portion is formed at a first end of the base plate, wherein the anchor portion has an anchor aperture formed through the first end of the base plate, wherein the anchor aperture has a soft edge, the anchor portion further comprising a ground face surface proximate to the anchor aperture, wherein a distance between the top surface and the ground face surface is less than a distance between the top surface and the substantially planar bottom surface. A tether apparatus is positioned partially within the anchor aperture and extending away from the anchor aperture, wherein a portion of the tether apparatus is positioned between the ground face surface and the ground surface, wherein the base plate remains stationary relative the ground surface when a force is applied to the tether apparatus.

The present disclosure can also be viewed as providing a method of making an anchor apparatus. In this regard, one embodiment of such a method, among others, can be broadly summarized by the following steps: forming a ground anchor having a base plate with a top surface and a substantially planar bottom surface, wherein the base plate has a plurality of picket-guide apertures formed therein between the top surface and the substantially planar bottom surface; providing at least one picket removably positionable through at least one of the picket-guide apertures; and forming an anchor portion at a first end of the base plate, wherein the anchor portion has an anchor aperture formed through the first end of the base plate, the anchor portion further comprising a ground face surface proximate to the anchor aperture, wherein a distance between the top surface and the ground face surface is less than a distance between the top surface and the substantially planar bottom surface.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Figure 1:
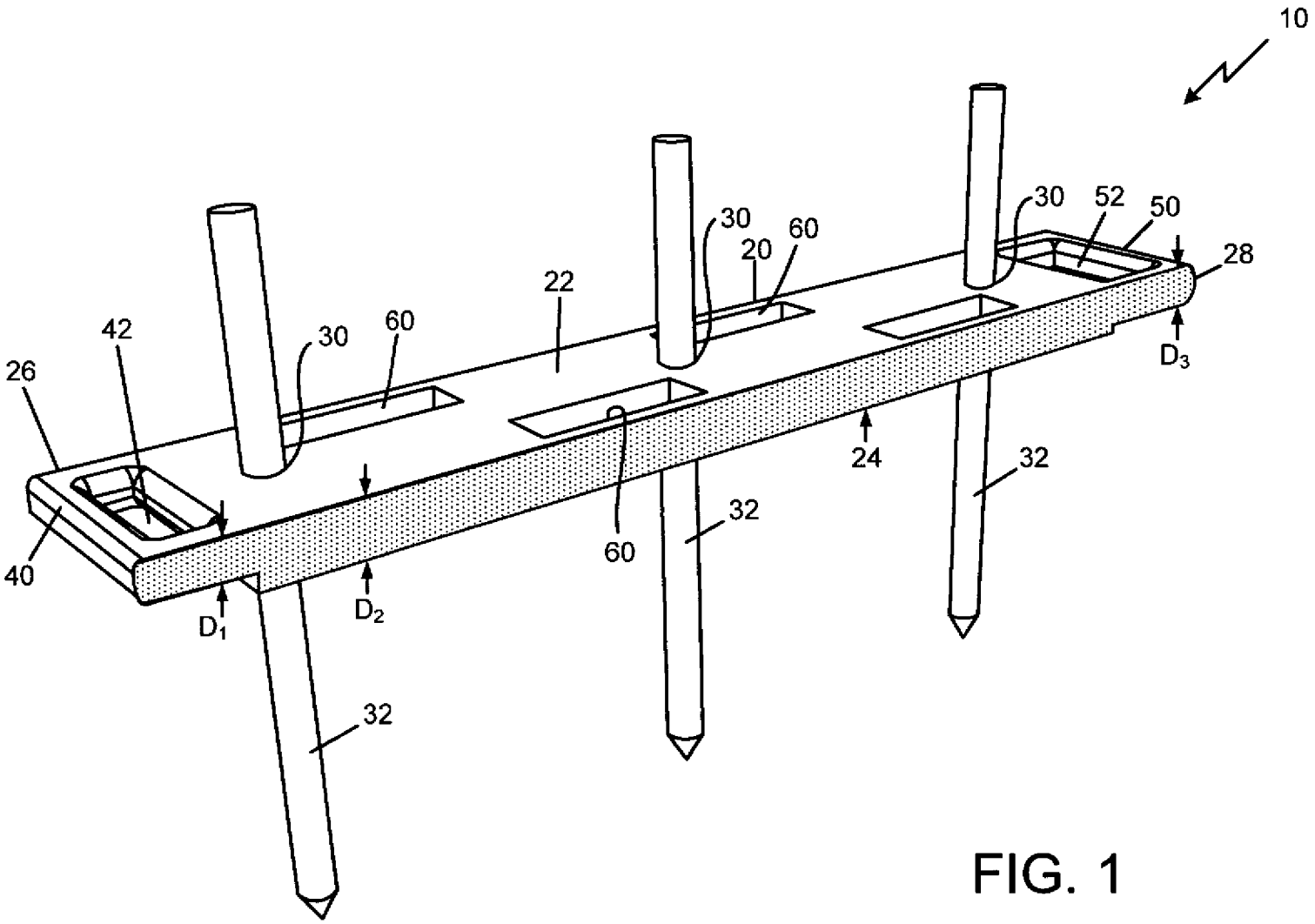
FIG. 1 is a top plan view illustration of an anchor apparatus, in accordance with a first exemplary embodiment of the present disclosure.
Figure 2:
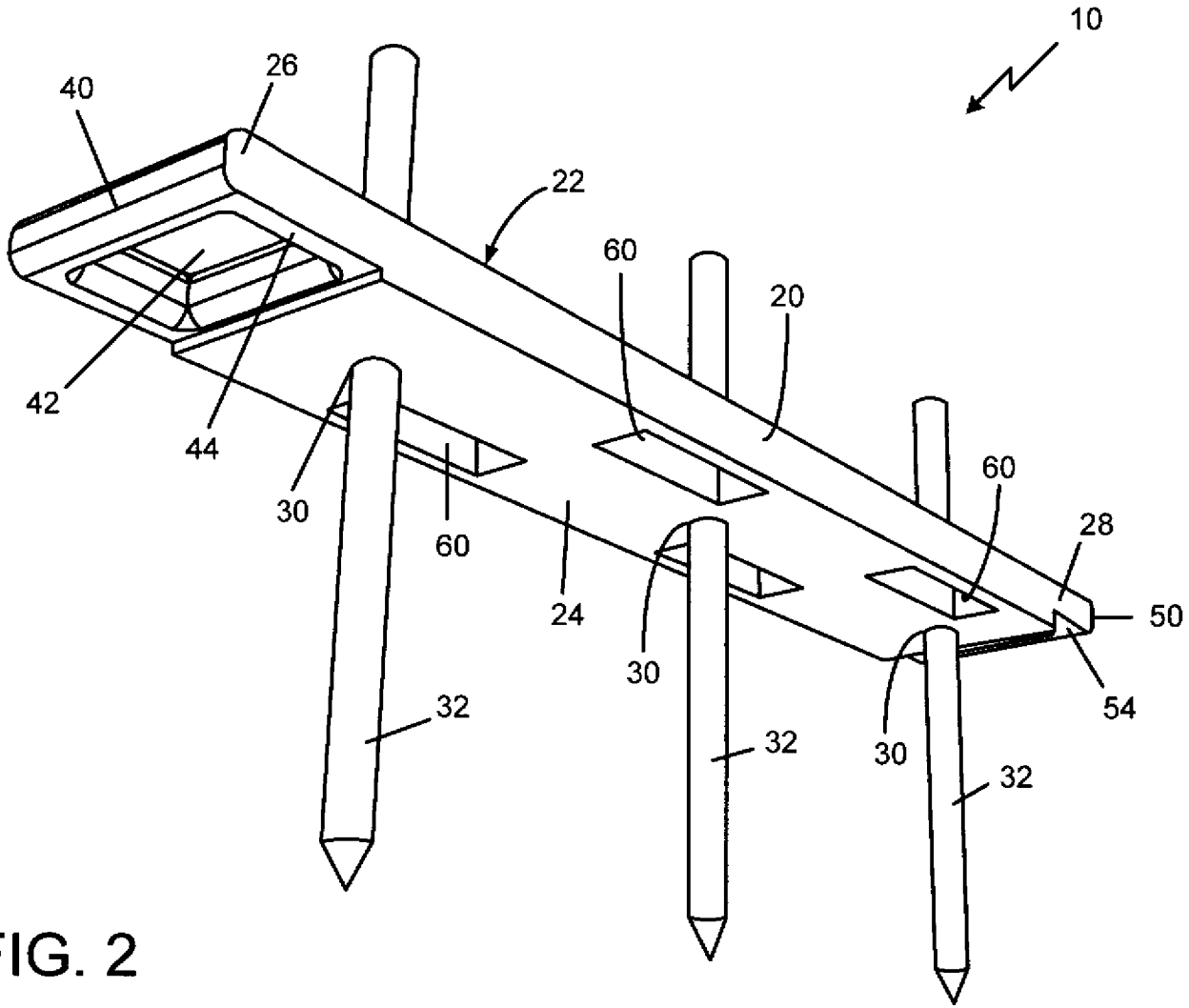
FIG. 2 is a bottom plan view illustration of the anchor apparatus of FIG. 1, in accordance with the first exemplary embodiment of the present disclosure.
Figure 3:
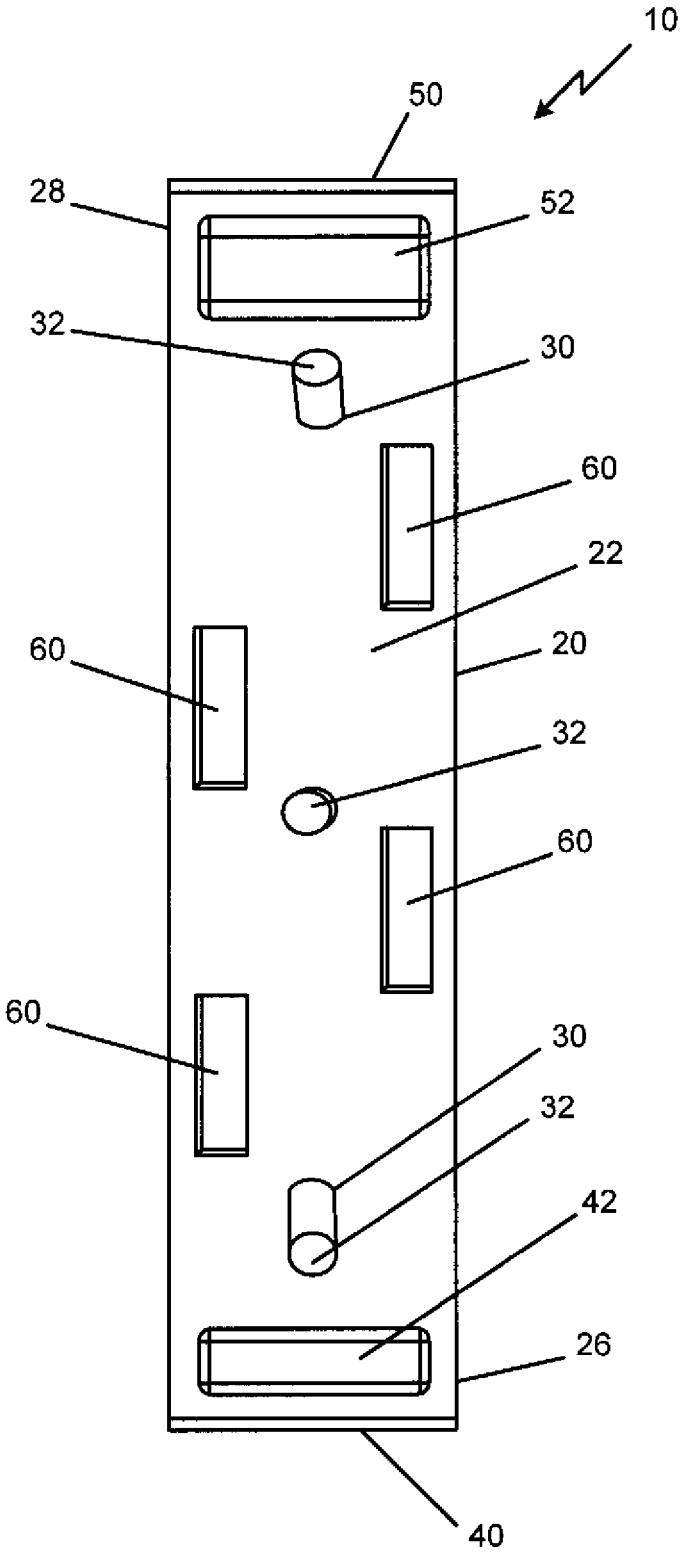
FIG. 3 is a top view illustration of the anchor apparatus of FIG. 1, in accordance with the first exemplary embodiment of the present disclosure.
Figure 4:
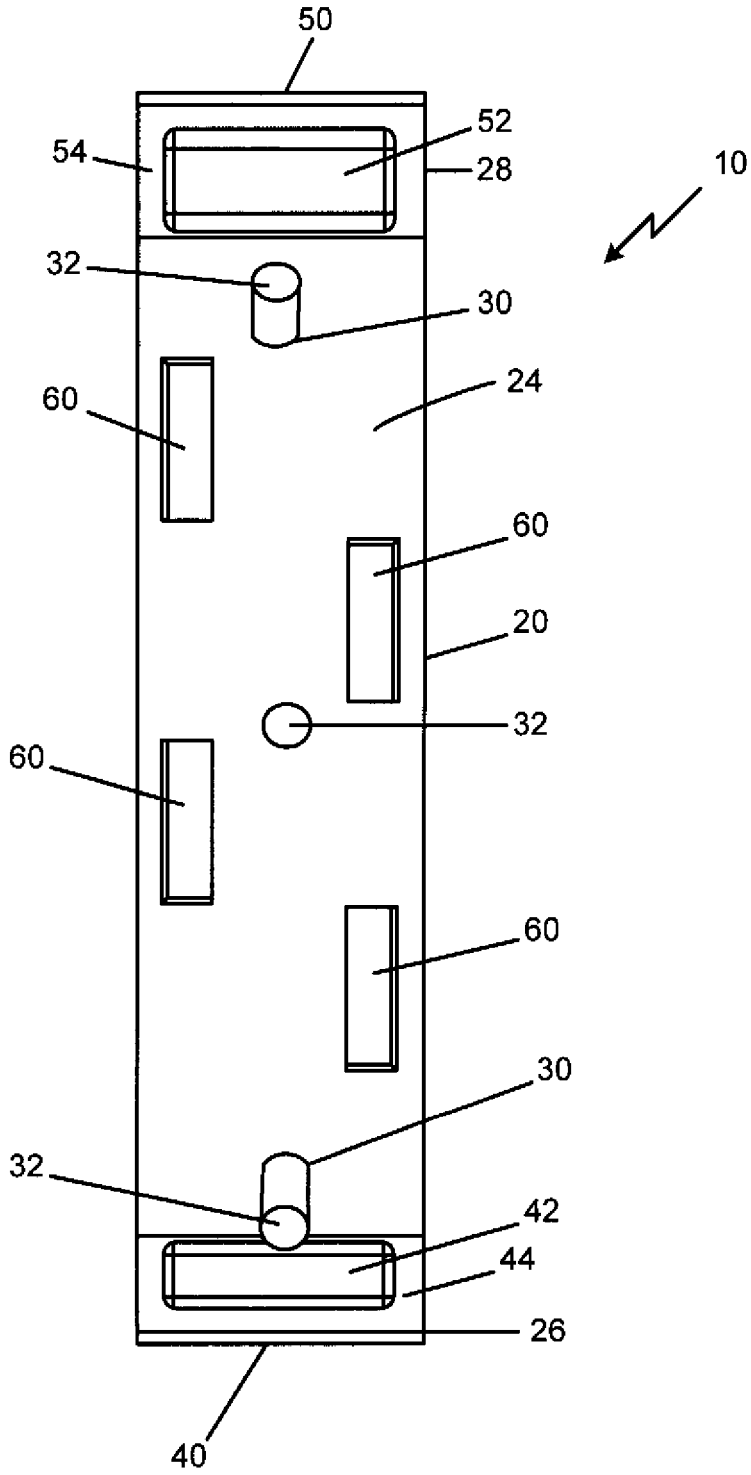
FIG. 4 is a bottom view illustration of the anchor apparatus of FIG. 1, in accordance with the first exemplary embodiment of the present disclosure.

FIG. 1 is a top plan view illustration of an anchor apparatus 10, in accordance with a first exemplary embodiment of the present disclosure. FIG. 2 is a bottom plan view illustration of the anchor apparatus 10 of FIG. 1, in accordance with the first exemplary embodiment of the present disclosure. FIG. 3 is a top view illustration of the anchor apparatus 10 of FIG. 1, in accordance with the first exemplary embodiment of the present disclosure. FIG. 4 is a bottom view illustration of the anchor apparatus 10 of FIG. 1, in accordance with the first exemplary embodiment of the present disclosure. With respect to FIGS. 1-4, the anchor apparatus 10, which may be referred to herein as 'apparatus 10' includes a base plate 20 having a top surface 22 and a substantially planar bottom surface 24, wherein the base plate 20 has a plurality of picket-guide apertures 30 formed therein between the top surface 22 and the substantially planar bottom surface 24. At least one picket 32 is removably positioned in at least a portion of the picket-guide apertures 30. An anchor portion 40 is formed at a first end 26 of the base plate 20, wherein the anchor portion 40 has an anchor aperture 42 formed through the first end 26 of the base plate 20, the anchor portion 40 further comprising a ground face surface 44 proximate to the anchor aperture 42, wherein a distance $D_1$ between the top surface 22 and the ground face surface 44 is less than a distance $D_2$ between the top surface 22 and the substantially planar bottom surface 24.

The base plate 20 may be a substantially solid, rigid structure that forms the general shape of the apparatus 10. For example, the base plate 20 may be constructed from a metal, such as an aluminum alloy with a protective coating, such as an anodized coating and/or anodic oxide coating. The base plate 20 may have black anodized layer throughout, including within the picket-guide apertures 30. The base plate 20 may have a variety of sizes and dimension. For example, the base plate 20 may be 6 inches wide, 35.5 inches in length, and 1.5 inches in thickness, i.e., at $D_2$. Preferably, the top surface 22 is oriented parallel to the substantially planar bottom surface 24, however variations may exist. The bottom surface 24 may be substantially planar to allow it to sit flush with a mounting surface, which will generally be planar, such as, for example, a paved or non-paved ground surface. The base plate 20 has a plurality of picket-guide apertures 30 formed therein between the top surface 22 and the substantially planar bottom surface 24.

The pickets 32 may be a structure with an elongated substantially cylindrical body and a tapered end that is formed from a substantially rigid, hardened, and durable material, such as steel, stainless steel, and/or hardened plastics. The size of the pickets 32 may vary depending on the design of the apparatus 10. For example, the picket 32 may be approximately 42 inches in length. The required length of the pickets 32 may depend on the ground that the apparatus 10 is anchored in. Softer soils and/or sand may require pickets 32 with longer lengths than hardened ground layers. In addition to a tapered end or point, which is helpful with driving the pickets 32 into a ground surface, the picket body may be slightly tapered along any portion of the picket 32 to ensure a tight fit between the picket 32 and the picket-guide aperture 30. When the pickets 32 are positioned within the picket-guide apertures 30, approximately 36 inches of the picket 32 may be positioned on one side of the base plate 20 (along the bottom surface 24), while approximately 6 inches may be position proximate to the top surface 22. The quantity and positioning of the pickets 32 and the picket-guide apertures 30 may vary, depending on the design and intended use of the apparatus 10. For example, as is shown in FIG. 1, there may be three picket-guide apertures 30 spatially positioned in the base plate 20, such as positioned substantially towards a center axis of the base plate 20.

The picket-guide apertures 30 may be machined or otherwise formed within the base plate 20. The diameter of the picket-guide apertures 30 may be matched to the picket 32 that is removably positionable within the picket-guide apertures 30. The optimal tolerance between the diameter of the picket-guide aperture 30 and the picket 32 may allow the picket 32 to be inserted into the picket-guide aperture 30 but provide for a substantially solid fit between the picket 32 and the picket-guide aperture 30, whereby movement of the picket 32 relative to the picket-guide aperture 30 may only be accomplished with a substantial force along the elongate axis of the picket 32, such as a force applied to the picket 32 from a hammer. The unitary assembly of the base plate 20 with the pickets 32 may prevent the pickets 32 from moving when force is applied to base plate 20, which may distribute any force applied to the base plate 20 evenly throughout the base plate 20.

The anchor portion 40 is formed at a first end 26 of the base plate 20 and may be used to facilitate anchoring to the base plate 20. The anchor portion 40 has an anchor aperture 42 formed through the first end 26 of the base plate 20. The anchor aperture 42 may be any shape or size, such as rectangular with straight edges, as is shown in FIG. 1. The anchor aperture 42 may have one or more soft edges, characterized as a non-sharp edge. For example, a soft edge may include any edge having a larger angle than 90°, such as a curvilinear edge, a chamfered edge, and/or a beveled edge. The soft edge may prevent a tether or other anchoring device from being severed or torn by an edge of the anchor aperture 42.

The anchor portion 40 has a ground face surface 44 positioned proximate to the anchor aperture 42, such as around one or more sides of the anchor aperture 42. The ground face surface may be positioned on the same side as the substantially planar bottom surface 24 of the base plate 20, such that it is located proximate to a ground surface when the base plate 20 is in an installed position. The distance between the top surface 22 and the ground face surface 44, identified as $D_1$, may be less than a distance between the top surface 22 and the substantially planar bottom surface 24, identified as $D_2$. When the base plate 20 is in an installed position with the substantially planar bottom surface 24 abutting a ground surface, the ground face surface 44 of the anchor portion 40 may be positioned a distance away from the ground surface, allowing a tether, rope, or anchoring structure to be positioned within the anchor aperture 42 without affecting the abutting position of the substantially planar bottom surface 24 to the ground surface.

It is noted that the ground face surface 44 may be positioned any distance away from the ground surface. Furthermore, while $D_1$ is identified as being less than $D_2$, the relative thicknesses may vary while still providing for the spaced relationship between the ground face surface 44 and the ground surface. For example, the top surface 22 of the base plate 20 around the anchor aperture 42 may be raised relative to the top surface 22 of the remaining portions of the base plate 20.

The apparatus 10 may also include handle portion 50 formed at a second end 28 of the base plate 20 which may allow a user to grasp the apparatus 10. The handle portion 50 may be substantially similar to the anchor portion 40, and may be used interchangeably with the anchor portion 40, such that either the anchor portion 40 or the handle portion 50 could be used as either an anchor or handle. The handle portion 50 has a handle-grip aperture 52 formed through the second end 28 of the base plate 20. The edges of the handle-grip aperture 52 may be soft edges, thereby providing for a more comfortable and easier handling of the apparatus 10 during use and between uses. Similar to the anchor portion 40, the handle portion 50 may include a handle ground face surface 54 located proximate to the handle-grip aperture 52, wherein a distance $D_3$ between the top surface 22 and the handle ground face surface 54 is less than a distance $D_2$ between the top surface 22 and the substantially planar bottom surface 24. While the exact dimensions of the handle ground face surface 54 may vary, it may be formed similar to the ground face surface 44.

The base plate 20 may further include at least one mass-reducing portion 60 formed within the base plate 20 between the top surface 22 and the substantially planar bottom surface 24. The mass-reducing portions 60 may include a hole or cut-out of material within the base plate 20 that acts to lessen the weight of the base plate 20. Any number of mass-reducing portions 60 may be included in the base plate 20, depending on the design and intended use of the apparatus 10, the number of which may be determined by the length, width, and thickness of the base plate 20. The positioning of the mass-reducing structures 60 may be selected to provide optimal mass and weight reduction of the base plate 20 without diminishing or compromising the structural integrity of base plate 20, such that the base plate 20 maintains a high-level of resilience in response to forces pulling against it. The mass-reducing structures 60 may be rectilinear in shape, or have another shape, and may be positioned alternating on opposing edges of the base plate 20.

Figure 5:
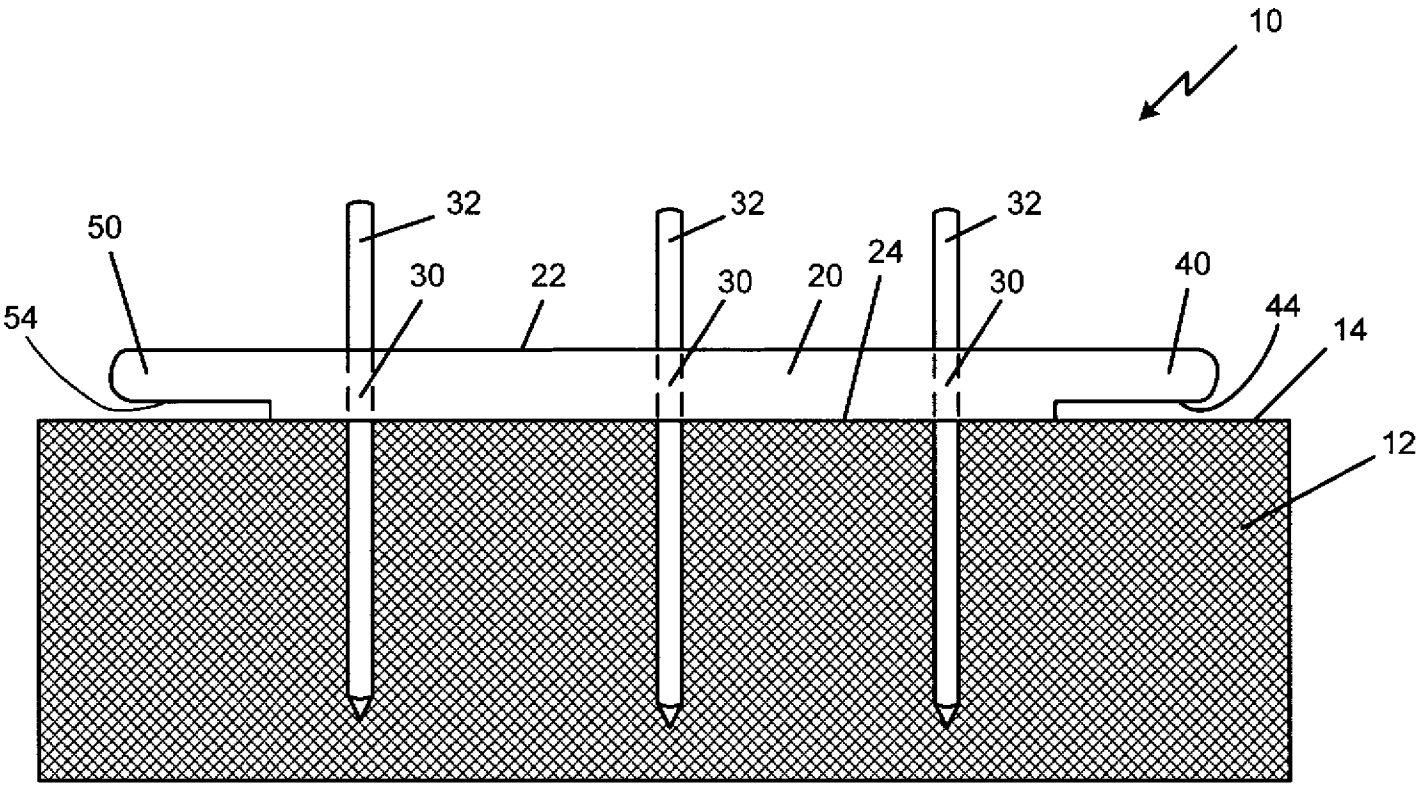
FIG. 5 is a cross-sectional side view illustration of the anchor apparatus of FIGS. 1-4, in an installed position, in accordance with the first exemplary embodiment of the present disclosure.

FIG. 5 is a cross-sectional side view illustration of the anchor apparatus 10 of FIGS. 1-4, in an installed position, in accordance with the first exemplary embodiment of the present disclosure. In the installed position, the substantially planar bottom surface 24 of the base plate 20 may be positioned abutting the ground surface 14 of the ground 12. The pickets 32 may be driven through the picket-guide apertures 30 of the base plate 20 and into the ground 12 to keep the base plate 20 in a substantially stationary position. As can be seen, the ground face surface 44 of the anchor portion 50 and the handle ground face surface 54 of the handle portion 50 may be spaced a distance away from the ground surface 14.

Figure 6:
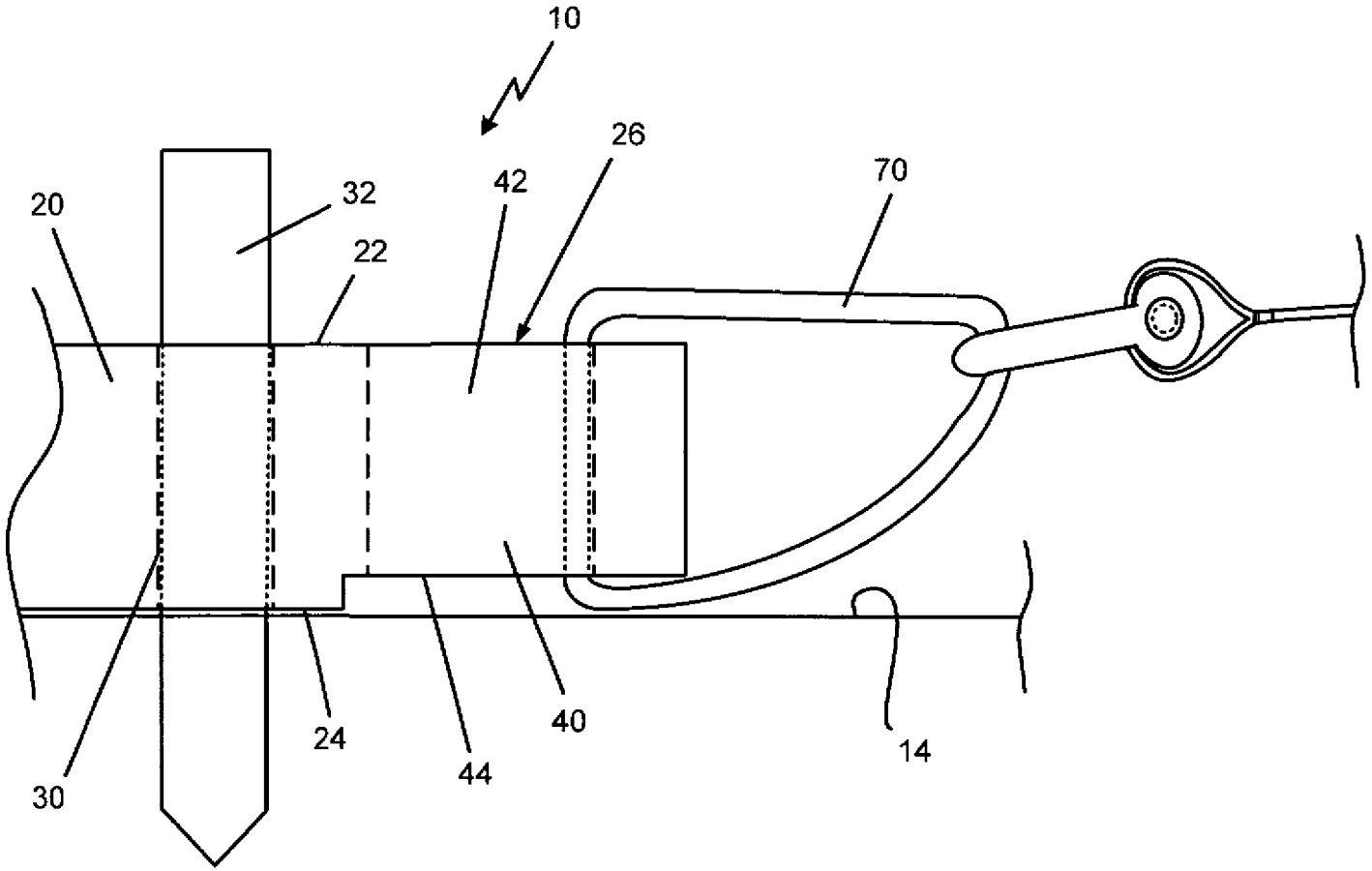
FIG. 6 is a side view illustration of the anchor apparatus of FIG. 1 in an installed position with a tether apparatus, in accordance with the first exemplary embodiment of the present disclosure.

FIG. 6 is a side view illustration of the anchor apparatus 10 of FIG. 1 in an installed position with a tether apparatus 70, in accordance with the first exemplary embodiment of the present disclosure. The tether apparatus 70 may be positioned on the anchor portion 40, at least partially within the anchor aperture 42 and extending away from the anchor aperture 42. The tether apparatus 70 may be a flexible, durable, and strong material, such as a wire cable, a rope, a belt, or other tethering material. A portion of the tether apparatus 70 is positioned between the ground face surface 44 and the ground surface 14. As can be seen, the distance between the ground face surface 44 and the ground surface 14 allows the tether apparatus 70 to be positioned within the anchor aperture 42 without negatively affecting the abutting positioning of the bottom surface 24 and the ground surface 14. Additionally, the ground face surface 44 may prevent the tether apparatus 70 from contacting the ground surface, which may be harmful to the fibers or materials of the tether apparatus 70. The tether apparatus 70 may also be prevented from contacting water, oil or other hazardous material that may surround the installed base plate 20, and thereby threaten the structural integrity of the tether apparatus 70. The base plate 20 can remain in a stationary position relative the ground surface 14 when a force is applied to the tether apparatus 70.

The apparatus 10 may be easily portable and provide significant benefits when existing natural or manmade anchors are not present at a site, or such existing anchors are marginal or not in an advantageous location for the operation at hand. The apparatus 10 may be used with any type of soil and ground condition and precludes unintentional dislodging for wide range of load bearing stress applied to the apparatus 10. This ability to withstand great forces may due to the angling of the picket-guide apertures 30 relative to the base plate 20 and the spacing of the pickets 32. The perpendicular angle of the picket-guide apertures 30 may provide for optimal strength, and thus greater resilience to and deformation. The spacing of the picket-guide apertures 30 may provide for the even distribution of tension force throughout the base plate 20 and the pickets 32 during anchorage.

Figure 7:
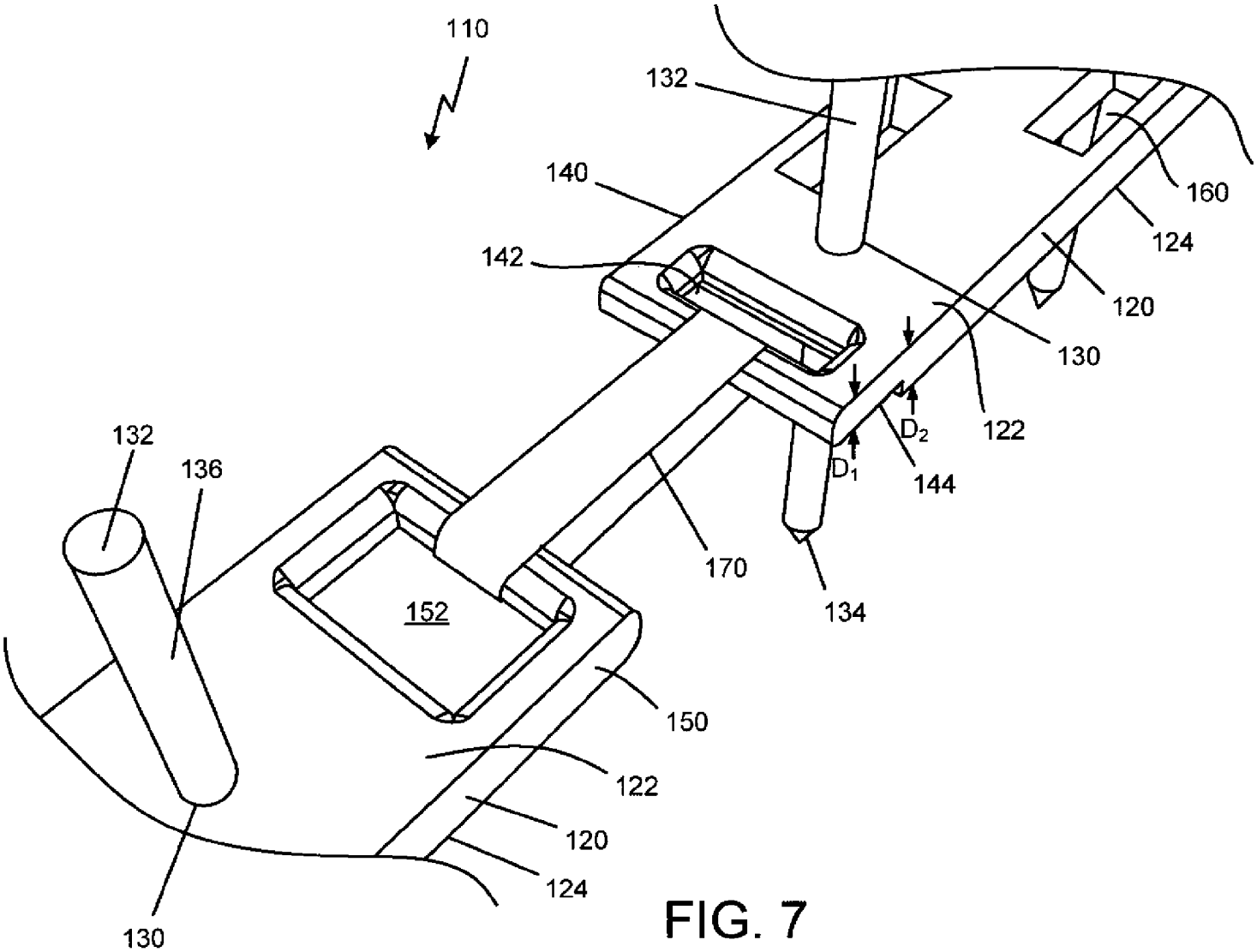
FIG. 7 is a plan view illustration of an anchor system, in accordance with a second exemplary embodiment of the present disclosure.

FIG. 7 is a plan view illustration of an anchor system 110, in accordance with a second exemplary embodiment of the present disclosure. The anchor system 110, which may be referred to herein as 'system 110' may include any of the components, features, and functions disclosed relative to FIGS. 1-6. The system 110 includes a base plate 110 having a top surface 122 and a substantially planar bottom surface 124. The base plate 120 has a plurality of picket-guide apertures 130 formed therein between the top surface 122 and the substantially planar bottom surface 124, wherein the substantially planar bottom surface 124 is positioned abutting a ground surface. A plurality of pickets 130 has an elongated substantially cylindrical body 136 and a tapered end 134. Each of the plurality of pickets 130 is removably positioned in one of the plurality of picket-guide apertures 132 along the elongated substantially cylindrical body of the plurality of pickets 132, wherein the tapered end 134 of the plurality of pickets 132 is positioned below the ground surface.

An anchor portion 140 is formed at a first end of the base plate 120. The anchor portion 140 has an anchor aperture 142 formed through the first end of the base plate 120, wherein the anchor aperture 142 has a soft edge. The anchor portion 142 has a ground face surface 144 proximate to the anchor aperture 142, wherein a distance $D_1$ between the top surface 122 and the ground face surface 144 is less than a distance $D_2$ between the top surface 122 and the substantially planar bottom surface 124. The system 110 may include a handle portion 150 having a handle aperture 152. The handle aperture 152 may have soft edges.

A tether apparatus 170 may be positioned partially within the anchor aperture 142 and extending away from the anchor aperture 142, wherein a portion of the tether apparatus 170 is positioned between the ground face surface 144 and the ground surface. The base plate 120 may remain stationary relative the ground surface when a force is applied to the tether apparatus 170. The tether apparatus 170 may be connected between the anchor aperture 142 of one base plate 120 and the handle aperture 152 of another base plate 120, as is shown in FIG. 7. This configuration of connecting together two base plates 120 with a tether apparatus 170 may allow for use of base plates 120 in series or 'daisy-chain' to form the system 110, thereby increasing the overall force resistance of the base plates 120.

Figure 8:
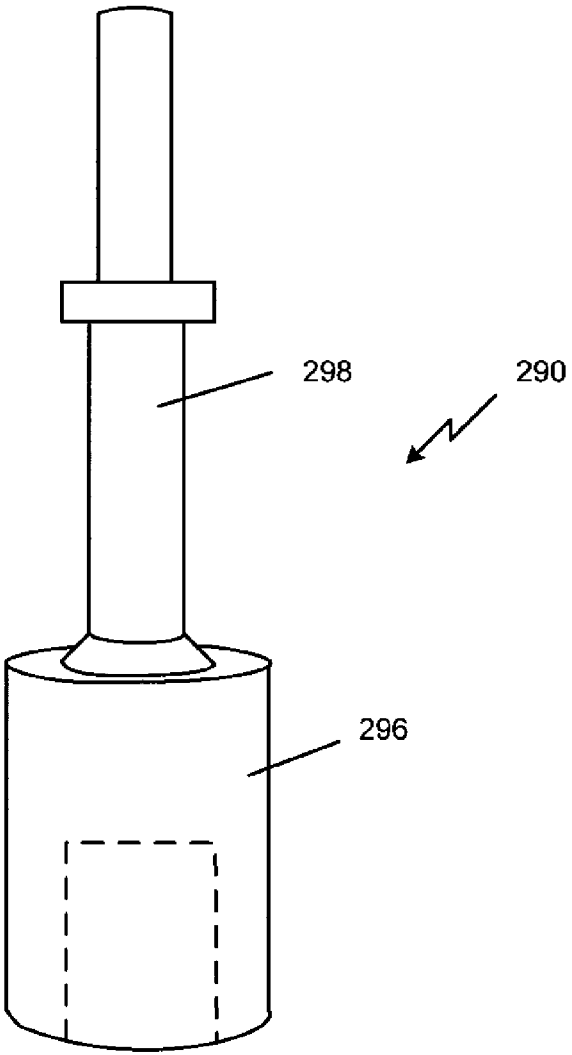
FIG. 8 is a plan view illustration of a picket driving assembly tool, in accordance with a third exemplary embodiment of the present disclosure.
Figure 9:
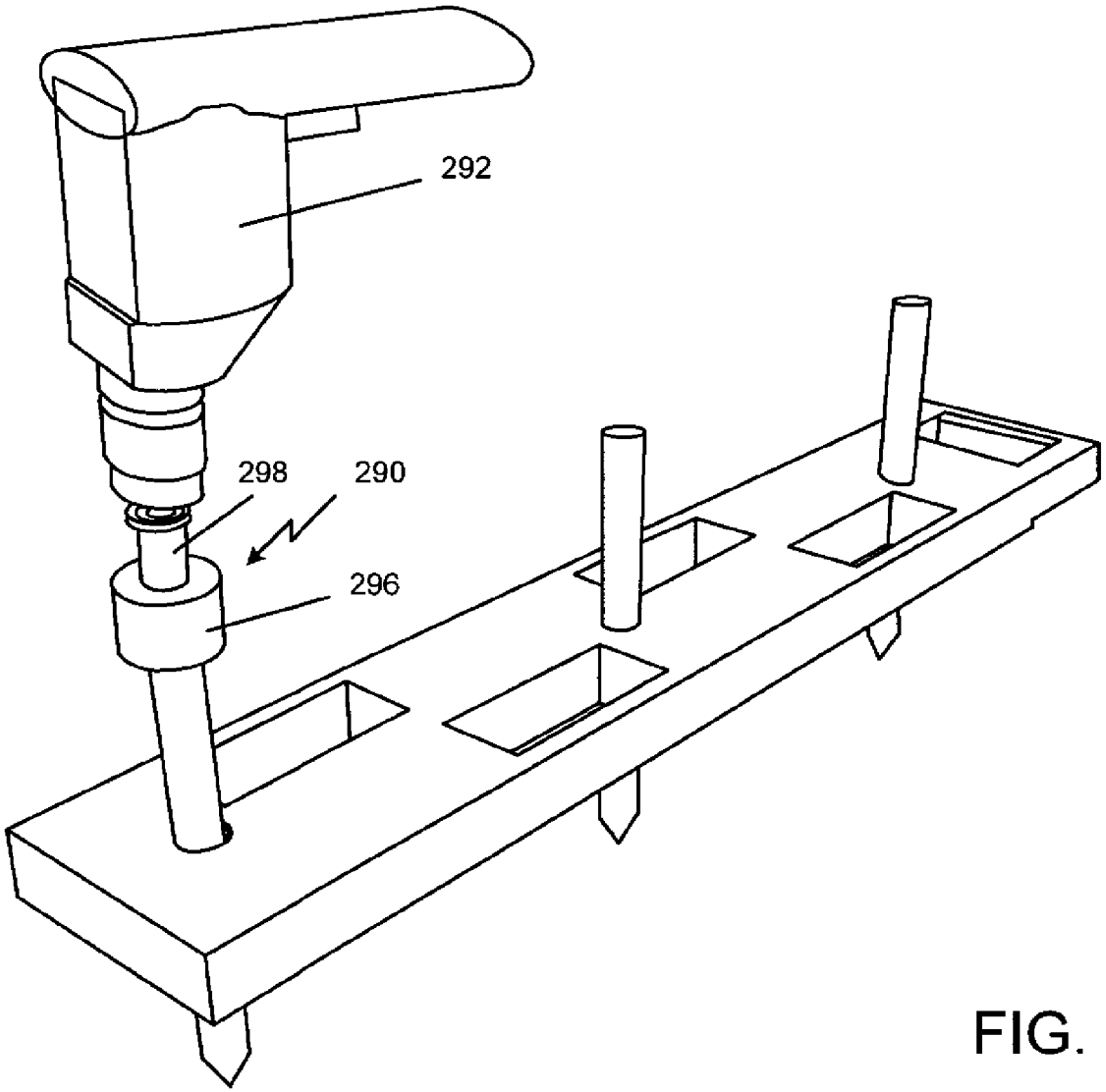
FIG. 9 is a plan view illustration of a picket driving assembly tool with a pneumatic hammer, in accordance with the third exemplary embodiment of the present disclosure.

FIG. 8 is a plan view illustration of a picket driving assembly tool 290, in accordance with a third exemplary embodiment of the present disclosure. FIG. 9 is a plan view illustration of a picket driving assembly tool 290 with a pneumatic hammer 292, in accordance with the third exemplary embodiment of the present disclosure. The picket driving assembly tool 290 and pneumatic hammer 292 may be used with the anchor 10 and/or anchor system 110 of FIGS. 1-7, and may include any of the components, features, and functions disclosed relative to FIGS. 1-7. The picket driving assembly tool 290 may be used to install the pickets within the picket-guide apertures of the base plate. The picket driving assembly tool 290 may include a receiving chamber 296 for contacting the picket and rod 298 for connection to a pneumatic hammer 294 (FIG. 9). The rod 298 may be inserted into a pneumatic hammer 294 to drive the pickets into the ground quickly, irrespective of the soil resistivity, and resist compressive forces that may cause the striking end of the engaging pickets to become deformed. The receiving chamber 296 may be applied to the top end of picket and receive it therein, such as within a hole or cavity formed within the receiving chamber 296. The hole or cavity may minimize deformation of the top of the picket. After picket is engaged into the ground, the receiving chamber 296 may drive the picket into the ground to the desired position.

Figure 10:
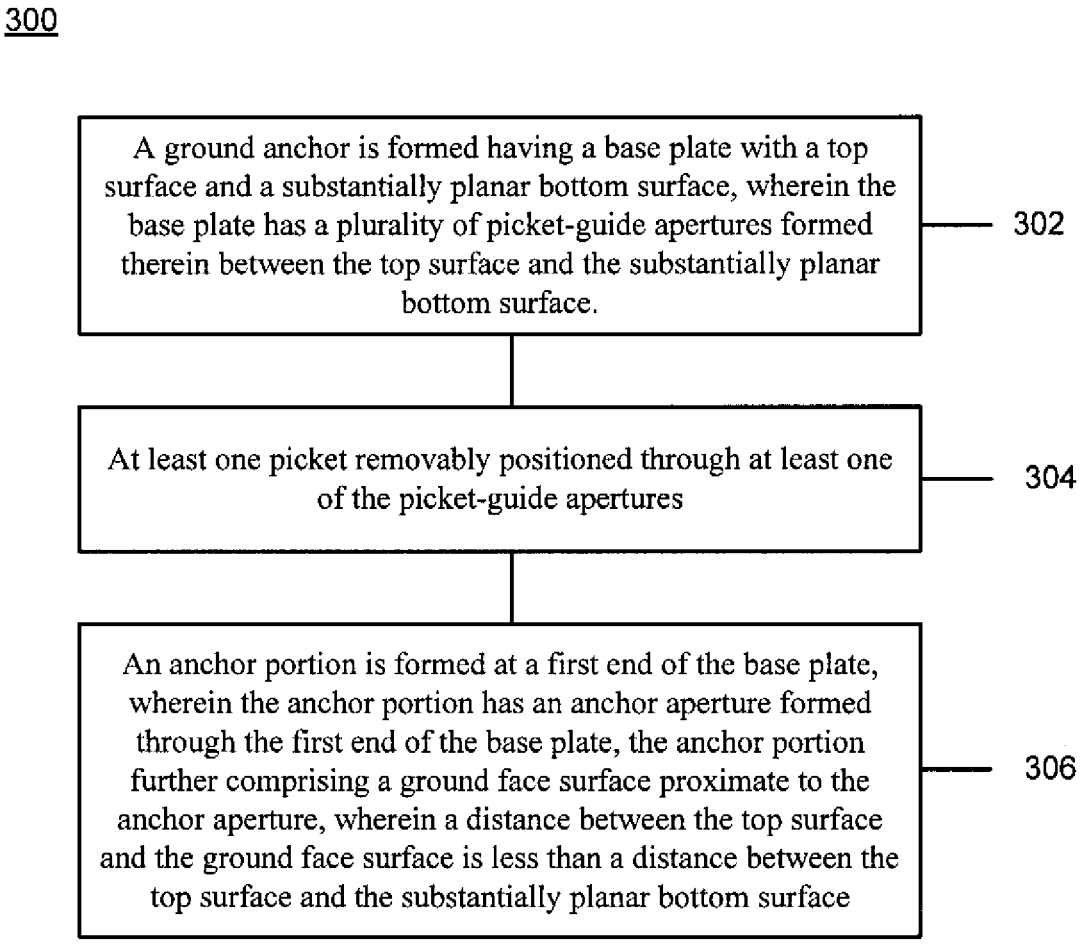
FIG. 10 is a flowchart illustrating a method of providing making an anchor apparatus, in accordance with a fourth exemplary embodiment of the present disclosure.

FIG. 10 is a flowchart 300 illustrating a method of providing making an anchor apparatus, in accordance with a fourth exemplary embodiment of the present disclosure. It should be noted that any process descriptions or blocks in flow charts should be understood as representing modules, segments, portions of code, or steps that include one or more instructions for implementing specific logical functions in the process, and alternate implementations are included within the scope of the present disclosure in which functions may be executed out of order from that shown or discussed, including substantially concurrently or in reverse order, depending on the functionality involved, as would be understood by those reasonably skilled in the art of the present disclosure.

As is shown by block 302, a ground anchor is formed having a base plate with a top surface and a substantially planar bottom surface, wherein the base plate has a plurality of picket-guide apertures formed therein between the top surface and the substantially planar bottom surface. At least one picket removably positioned through at least one of the picket-guide apertures (block 304). An anchor portion is formed at a first end of the base plate, wherein the anchor portion has an anchor aperture formed through the first end of the base plate, the anchor portion further comprising a ground face surface proximate to the anchor aperture, wherein a distance between the top surface and the ground face surface is less than a distance between the top surface and the substantially planar bottom surface (block 306).

The method may include any number of additional steps, including any of the functions, steps, processes, and structures disclosed relative to FIGS. 1-9. For example, an object may be anchored to the base plate using the anchor portion by connecting a tether apparatus between the object and the anchor aperture, wherein a portion of the tether apparatus is positioned between the ground face surface and the ground surface. A force may be applied to the tether apparatus, wherein the substantially planar bottom surface of the base plate remains in abutment with the ground surface when the force is applied to the tether apparatus. When the force is applied, the base plate may remain stationary relative the ground surface when a force is applied to the tether apparatus.

It should be emphasized that the above-described embodiments of the present disclosure, particularly, any "preferred" embodiments, are merely possible examples of implementations, merely set forth for a clear understanding of the principles of the disclosure. Many variations and modifications may be made to the above-described embodiment(s) of the disclosure without departing substantially from the spirit and principles of the disclosure. All such modifications and variations are intended to be included herein within the scope of this disclosure and the present disclosure and protected by the following claims.

What is claimed is:

1. An anchor apparatus comprising:

a base plate having a top surface and a substantially planar bottom surface, wherein the base plate has a plurality of picket-guide apertures formed therein between the top surface and the substantially planar bottom surface;

at least one picket removably positioned in at least a portion of the picket-guide apertures; and an anchor portion formed at a first end of the base plate, wherein the anchor portion has an anchor aperture formed through the first end of the base plate, the anchor portion further comprising a ground face surface proximate to the anchor aperture, wherein a distance between the top surface and the ground face surface is less than a distance between the top surface and the substantially planar bottom surface.

2. The anchor apparatus of claim 1, further comprising a handle portion formed at a second end of the base plate, wherein the second end is opposite the first end, the handle portion having a handle-grip aperture formed through the second end of the base plate.

3. The anchor apparatus of claim 2, wherein the handle portion further comprises a handle ground face surface proximate to the handle-grip aperture, wherein a distance between the top surface and the handle ground face surface is less than a distance between the top surface and the substantially planar bottom surface.

4. The anchor apparatus of claim 1, wherein the anchor aperture further comprises a soft edge.

5. The anchor apparatus of claim 4, wherein the soft edge further comprises at least one of: a curvilinear edge, a chamfered edge, and a beveled edge.

6. The anchor apparatus of claim 1, further comprising at least one mass-reducing portion within the base plate, wherein the at least one mass-reducing portion includes at least one hole formed within the base plate.

7. The anchor apparatus of claim 1, further comprising a protective coating formed on a surface of the base plate.

8. The anchor apparatus of claim 7, wherein the protective coating further comprises an anodic oxide coating.

9. The anchor apparatus of claim 1, wherein the at least one picket further comprises an elongated substantially cylindrical body and a tapered end.

10. The anchor apparatus of claim 1, wherein the at least one picket further comprises at least three pickets, wherein each of the at least three pickets is removably positioned in one of the picket-guide apertures, wherein the picket-guide apertures are spatially positioned in the base plate.

11. The anchor apparatus of claim 1, wherein the at least one picket is drivable into a ground surface with a pneumatic hammer and picket driving assembly tool.

12. The anchor apparatus of claim 1, wherein the base plate is formed from aluminum.

13. A ground anchor system, comprising:

a base plate having a top surface and a substantially planar bottom surface, wherein the base plate has a plurality of picket-guide apertures formed therein between the top surface and the substantially planar bottom surface, wherein the substantially planar bottom surface is positioned abutting a ground surface;

a plurality of pickets having an elongated substantially cylindrical body and a tapered end, each of the plurality of pickets removably positioned in one of the plurality of picket-guide apertures along the elongated substantially cylindrical body of the plurality of pickets, wherein the tapered end of the plurality of pickets is positioned below the ground surface;

an anchor portion formed at a first end of the base plate, wherein the anchor portion has an anchor aperture formed through the first end of the base plate, wherein the anchor aperture has a soft edge, the anchor portion further comprising a ground face surface proximate to the anchor aperture, wherein a distance between the top surface and the ground face surface is less than a distance between the top surface and the substantially planar bottom surface; and a tether apparatus positioned partially within the anchor aperture and extending away from the anchor aperture, wherein a portion of the tether apparatus is positioned between the ground face surface and the ground surface, wherein the base plate remains stationary relative the ground surface when a force is applied to the tether apparatus.

14. The ground anchor system of claim 13, wherein the substantially planar bottom surface of the base plate remains in abutment with the ground surface when the force is applied to the tether apparatus.

15. The ground anchor system of claim 13, further comprising a handle portion formed at a second end of the base plate, wherein the second end is opposite the first end, the handle portion having a handle-grip aperture formed through the second end of the base plate.

16. The ground anchor system of claim 15, further comprising:

a second base plate, wherein the second base plate comprises:

a top surface and a substantially planar bottom surface, wherein the second base plate has a plurality of picket-guide apertures formed therein between the top surface and the substantially planar bottom surface;

at least one picket removably positioned in at least a portion of the picket-guide apertures; and an anchor portion formed at a first end of the base plate, wherein the anchor portion has an anchor aperture formed through the first end of the second base plate, the anchor portion further comprising a ground face surface proximate to the anchor aperture, wherein a distance between the top surface and the ground face surface is less than a distance between the top surface and the substantially planar bottom surface, wherein a second tether apparatus is connected between the handle-grip aperture of the base plate and the anchor portion of the second base plate.

* * * * *